US005535679A

United States Patent [19]

Craddock

[11] Patent Number: 5,535,679

[45] Date of Patent: Jul. 16, 1996

[54] LOW VELOCITY RADIAL DEPLOYMENT WITH PREDETERMINED PATTERN

[75] Inventor: Gerald G. Craddock, Arlington, Tex.

[73] Assignee: Loral Vought Systems Corporation, Grand Prairie, Tex.

[21] Appl. No.: 360,977

[22] Filed: Dec. 20, 1994

[51] Int. Cl.[6] ..... F42B 12/32

[52] U.S. Cl. ..... 102/494; 102/389; 102/489; 102/491

[58] Field of Search ..... 102/473, 489, 102/491, 492, 494, 495, 496, 497, 701, 389, 493

[56] References Cited

U.S. PATENT DOCUMENTS

| | | | |
|---|---|---|---|
| 1,154,437 | 9/1915 | Rimailho | 102/496 |
| 3,263,612 | 8/1966 | Throner, Jr. | 102/67 |
| 3,474,731 | 10/1969 | Thomanek | 102/52 |
| 3,498,224 | 3/1970 | Cordle et al. | 102/67 |
| 3,667,390 | 6/1972 | Medin et al. | 102/494 |
| 3,967,553 | 7/1976 | Keraus et al. | 102/495 |
| 3,974,771 | 8/1976 | Thomanek | 102/494 |
| 3,977,327 | 8/1976 | Brumfield et al. | 102/494 |
| 4,026,213 | 5/1977 | Kempton | 102/56 SC |
| 4,303,015 | 12/1981 | Bourlet | 102/492 |
| 4,351,240 | 9/1982 | McCubbin et al. | 102/496 |
| 4,430,941 | 2/1984 | Raech, Jr. et al. | 102/496 |
| 4,768,440 | 9/1988 | Deneuville et al. | 102/495 |
| 5,038,686 | 8/1991 | Zulkoski et al. | 102/496 |
| 5,064,462 | 11/1991 | Mullendore et al. | 102/518 |

FOREIGN PATENT DOCUMENTS

| | | | |
|---|---|---|---|
| 338874 | 10/1989 | European Pat. Off. | 102/491 |
| 2262416 | 7/1973 | Germany | 102/491 |

*Primary Examiner*—Harold J. Tudor
*Attorney, Agent, or Firm*—Richards, Medlock & Andrews

[57] ABSTRACT

A plurality of objects is deployed in generally radial directions at a low velocity in order to achieve a predetermined pattern of the deployed objects. The device has an inner wall member (20), an annular body (43) of low velocity explosive, at least a first plurality of objects (56) in a first annular array (51) and a second plurality of objects (56) in a second annular array (52) positioned coaxially with and exteriorly of the annular body (43) of low velocity explosive, the arrays being positioned at different locations along the length of the annular body (43) of low velocity explosive such that the objects in each array are provided with an amount of energy different from that provided to each of the objects in the adjacent array. Each of the objects (56) has a shape which minimizes aerodynamically induced deviations in the path of the object during deployment, a mass of at least 50 grams, and a density of at least 15 g/cc. The objects (56) can be positioned in a matrix (57) of a synthetic polymeric material containing hollow glass microspheres. The low velocity explosive has a detonation velocity of less than 5500 meters per second, and the resulting radial deployment velocity of the objects is less than about 1000 feet per second.

36 Claims, 4 Drawing Sheets

LOW VELOCITY RADIAL DEPLOYMENT WITH PREDETERMINED PATTERN

FIELD OF THE INVENTION

This invention relates to a device for deploying a plurality of precisely shaped objects at low velocities to provide a desired dispersed pattern of the objects. The invention can be employed in an interceptor missile for the purpose of increasing the area of potential impact with a target.

BACKGROUND OF THE INVENTION

Two basic approaches to endoatmospheric non-nuclear destruction of an incoming missile or aircraft are 1) hit-to-kill by directly impacting the target with a large, heavy interceptor mass at high velocity, and 2) blast-fragmentation involving multiple impacts of small fragments at very high velocities and strike angles (from the interceptor's nose) resulting from the explosion of a high explosive warhead in the interceptor in the vicinity of the ballistic missile.

The hit-to-kill or kinetic energy technology approach is based on the fact that when one object strikes another object at high speeds, a tremendous amount of destructive energy is released. The impact of an interceptor missile with an incoming tactical ballistic missile, aircraft, or cruise missile, can result in the total disintegration of both vehicles. Such impact can literally vaporize even metals. In contrast, blast-fragmentation warheads may only redirect or break up the target vehicle. However, even with a large hit-to-kill interceptor, the effective impact window is relatively small.

Cordle et al, U.S. Pat. No. 3,498,224, discloses a fragmentation warhead comprising a solid high explosive charge surrounded by a series of five axially spaced steps, with each of four of the steps containing a different number of circumferential layers of steel cubes to yield a fragment beam pattern made up of fragments having varying velocities. As illustrated in FIG. 5 of Cordle et al, each of the deployment velocities is substantially greater than the missile velocity $V_M$. The five steps could be considered to be five separate warheads joined in tandem, with each warhead section employing a different uniform charge-to-metal ratio. The fragmentation pattern presented to an area some uniform distance away (large in proportion to the size of the warhead) is said to be extremely dense and in a relatively narrow beam on the order of 10° wide. The fragments are identified as 3/16 inch steel cubes, with the weight of each of the fragments being 13 grains.

Thomanek, U.S. Pat. No. 3,474,731, describes a fragmentation warhead for use against personnel in an armored target. The warhead has a fragmentation casing arranged to separate into a multiplicity of elements upon detonation of the high explosive charge. The elements, which can be embedded in a synthetic resin, can be spherical, disk-shaped, or irregularly shaped. The fragmentation casing can be configured to direct the fragmentation elements in a number of specific directions.

Kempton, U.S. Pat. No. 4,026,213, discloses an aimable warhead having a thin metal outer skin and a stronger inner metal casing. The high explosive is contained in the annular space between the two shells, and is in contact with a plurality of circumferentially spaced initiators. A selected initiator can be fired to rupture an arcuate section of the outer skin while not causing a detonation of the main charge, and then another initiator can be fired to detonate the main charge, thereby fragmenting the thicker inner casing and driving the fragments through the ruptured arcuate section.

Throner, Jr., U.S. Pat. No. 3,263,612, describes a fragmentation weapon wherein the fragments in a first group of fragments are large in size and the fragments in a second group of fragments are smaller in size. The fragments can be positioned about a charge of high explosive and initially bonded together by a matrix of plastic resin and then covered with a sheath formed from fiberglass impregnated with plastic resin. Each of the larger fragments can have a mass of about 140 grains while each of the smaller fragments can have a mass of about 30 grains. Although the shape of the fragments is stated to not be critical, cubes are preferred.

Raech, Jr. et al, U.S. Pat. No. 4,430,941, describes a projectile in which packs of flechettes are supported by a frangible matrix of small smooth glass microspheres bound together and to the flechettes by resin. The matrix prevents the flechettes from being damaged during acceleration of the projectile.

Bourlet, U.S. Pat. No. 4,303,015, describes a pre-fragmented explosive shell wherein a plurality of balls is housed in an annulus about a high explosive charge. The balls can have a tungsten or tungsten carbide core with a zirconium coating.

While the foregoing patents disclose warheads producing fragment patterns utilizing discrete small pre-formed fragments, none discloses the use of a "slow" or low explosive propellant to radially deploy a plurality of precisely shaped high mass objects at low velocities to provide a desired dispersed pattern of the objects, whereby the effective hit-to-kill window is enhanced.

SUMMARY OF THE INVENTION

The present invention is a device for deploying a plurality of objects in generally radial directions at a low velocity in order to achieve a predetermined pattern of the deployed objects, said device comprising:

an inner wall member;

an annular body of low velocity explosive positioned exteriorly of and coaxially with the inner wall member;

at least a first and a second plurality of objects, each plurality of objects being positioned in its respective annular array coaxially with and exteriorly of the annular body of low velocity explosive, the annular arrays being positioned at different locations along the central longitudinal axis of the annular body of low velocity explosive such that the energy provided each of the objects in the first annular array by the amount of the low velocity explosive in radial alignment with the first annular array is different from the energy provided each of the objects in the second annular array by the amount of the low velocity explosive in radial alignment with the second annular array.

In a presently preferred embodiment, each of the objects has a shape which minimizes aerodynamically induced deviations in the path of the object during the deployment of the object, a mass of at least 50 grams, and a density of at least 15 g/cc, and the objects are positioned in a matrix of a synthetic polymeric material containing hollow glass microspheres. It is preferred that the low velocity explosive have a detonation velocity of less than 5000 meters per second and more preferably less than 4000 meters per second. The resulting radial deployment velocity of the objects will preferably be less than about 600 feet per second and more preferably less than about 500 feet per second.

Thus, in accordance with the present invention, the hit-to-kill effect can be enhanced by a small, lightweight, agile interceptor that does not pre-empt a direct hit, and which incorporates a small number of fragments of high mass density which are deployable in a desired pattern with low deployment velocities and low strike angles, thereby substantially increasing the effective impact window.

DETAILED DESCRIPTION

Figure 1:
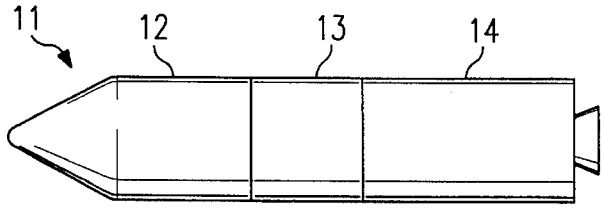
FIG. 1 is a side view of a missile incorporating the present invention.

Referring now to FIG. 1, the interceptor missile 11 comprises a guidance section 12, a warhead section 13, and a rocket propulsion section 14 joined together along the longitudinal axis 15 (FIG. 2) of the missile 11. The guidance section 12 contains suitable guidance components, e.g. a guidance sensor, an inertial measurement unit, a guidance processor, and a guidance control unit for effecting guidance control of the missile 11, e.g. by positioning of aerodynamic fins or by firing attitude control rocket thrusters. The interceptor missile can be ground-launched and inertially guided by aerodynamic fins toward a predicted intercept point. In the final flight phase, the on-board guidance sensor, which can be an active radar seeker, acquires the target and provides instantaneous data to the on-board guidance processor. The guidance processor can calculate an updated predicted intercept point with the target, and can provide homing guidance signals to control the firing of small solid rocket thrusters mounted near the nose of the interceptor missile 11. In accordance with the present invention, the warhead section 13 is a lethality enhancing device for radially deploying a plurality of objects at a low velocity in order to achieve a predetermined pattern of the deployed objects. The propulsion section 14 can be any suitable rocket motor. The relatively small size of the interceptor missile 11 enables the missile 11 to respond rapidly to guidance commands.

Figure 4:
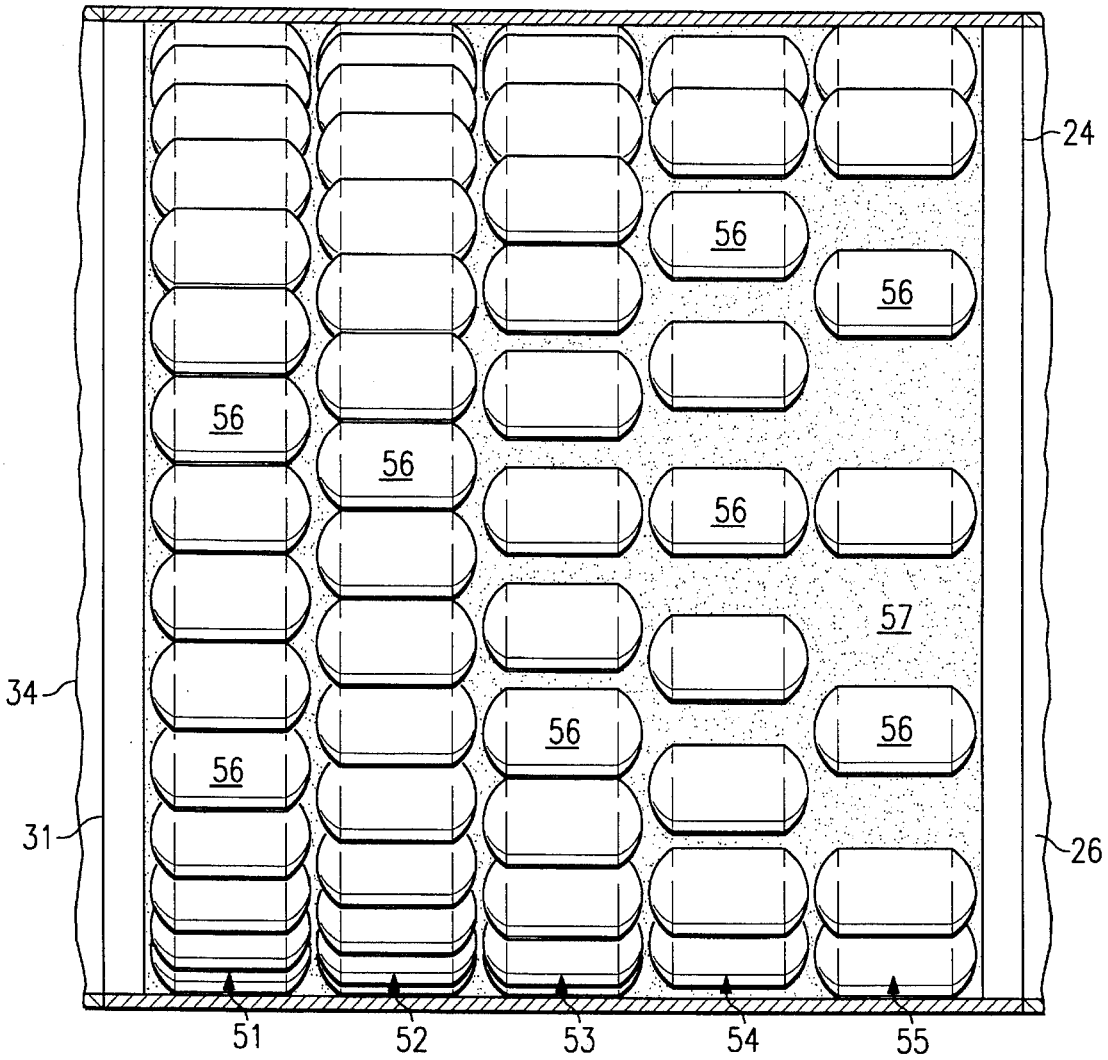
FIG. 4 is a side view of the warhead section of the missile of FIG. 1, with the external shell in cross-section and the outer portion of the support matrix removed.
Figure 2:
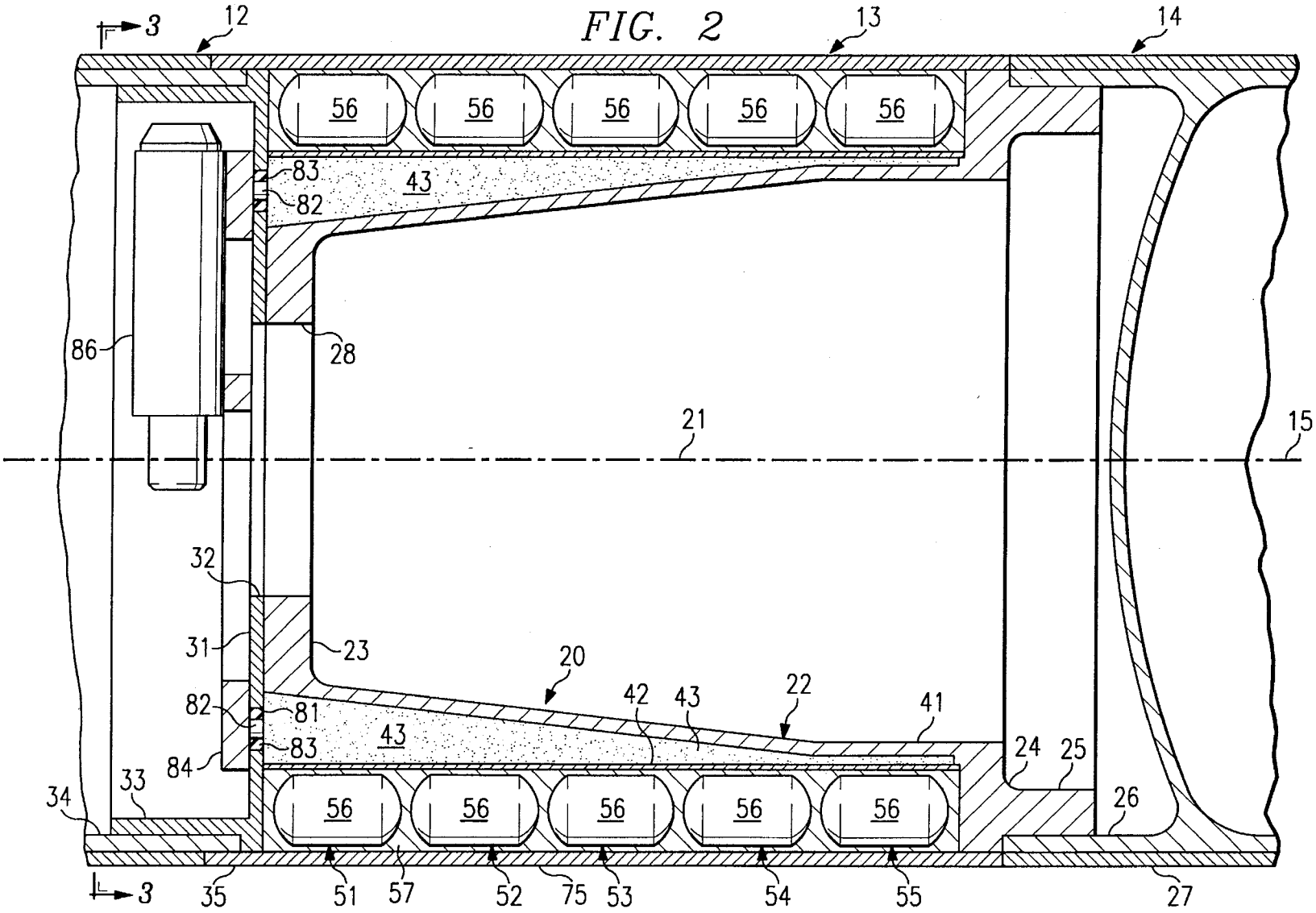
FIG. 2 is a cross-sectional view along a portion of the longitudinal axis of the missile of FIG. 1.
Figure 3:
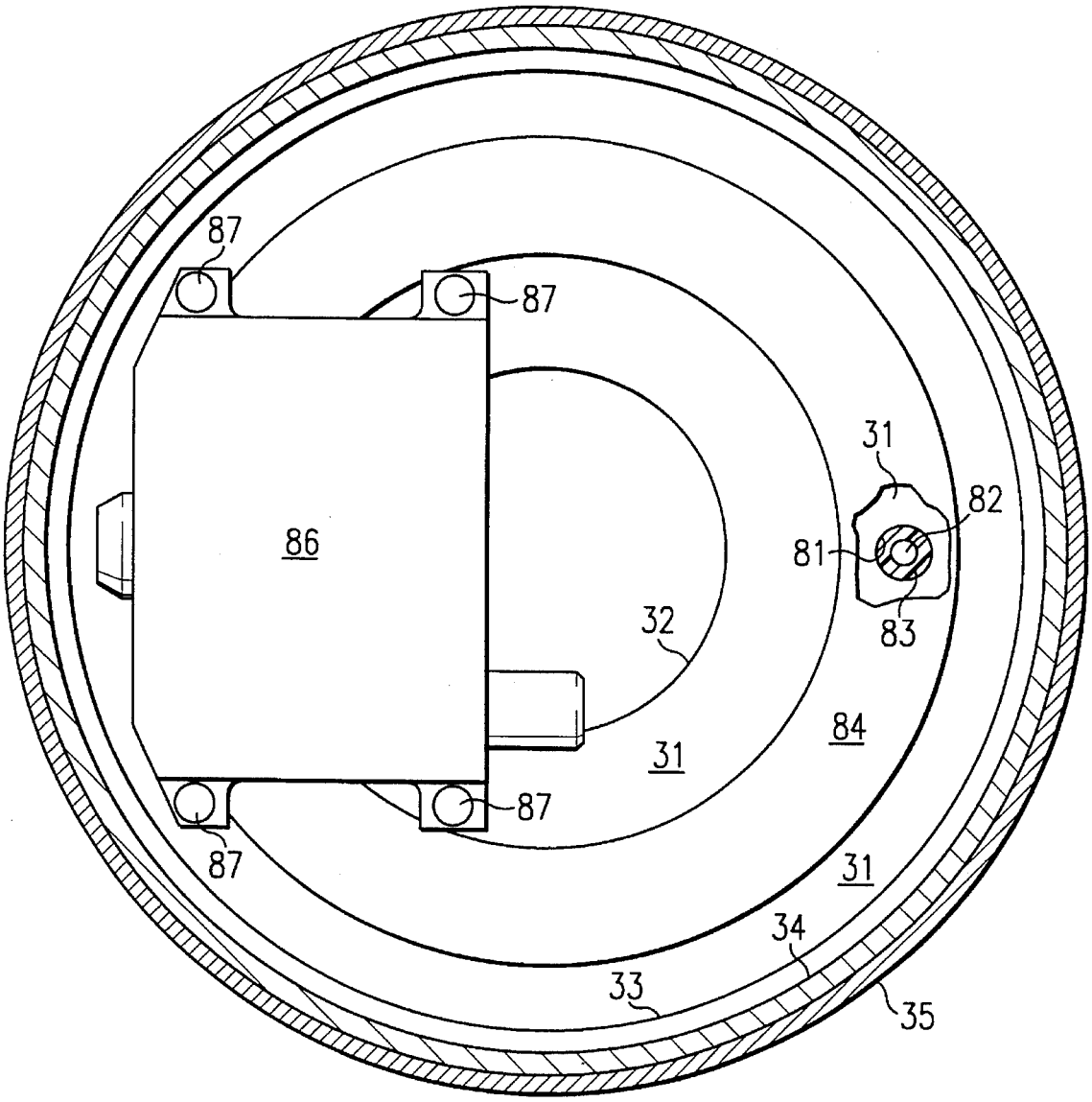
FIG. 3 is a cross-sectional view taken along line 3—3 in FIG. 2.

Referring now to FIGS. 2–4, the lethality enhancing device 13 has an inner wall member 20 having a central longitudinal axis 21 which coincides with the longitudinal axis 15 of the interceptor missile 11. The wall member 20 is illustrated as having a generally frustoconical elongated section 22 with a radially inwardly directed flange 23 at the forward end of the section 22 and a radially outwardly directed flange 24 at the aft end of the section 22. An annular flange 25 extends axially rearwardly from the radial flange 24, with the external diameter of the axial flange 25 being less than the external diameter of radial flange 24 so as to provide a mounting shoulder for receiving the forwardly extending annular flange 26 of the propulsion section 14, whereby the propulsion section 14 and the lethality enhancing device 13 can be joined together by suitable means, e.g. radially extending screws (not shown) extending through the annular flange 26 into the axially extending flange 25. An ablator layer 27 can be provided on the exterior surface of propulsion section 14 to protect the propulsion section 14 during a flight of the interceptor missile 11.

The forward radial flange 23, having a centrally located opening 28 therein, is mounted by suitable means, e.g. axially extending screws (not shown) to a radially extending plate 31, also having a centrally located opening 32 therein which matches opening 28 in flange 23. An annular flange 33 extends axially forwardly from the plate 31, with the external diameter of the axial flange 33 being less than the external diameter of plate 31 so as to provide a mounting shoulder for receiving the rearwardly extending annular flange 34 of the guidance section 12, whereby the guidance section 12 and the lethality enhancing device 13 can be joined together by suitable means, e.g. radially extending screws (not shown) extending through the annular flange 34 into the axially extending flange 33. An ablator layer 35 can be provided on the exterior surface of guidance section 12 except for sensor ports to protect the guidance section 12 during a flight of the interceptor missile 11.

The generally frustoconical elongated section 22 is an annular wall having a smaller external diameter at the forward end than at the aft end. The generally frustoconical elongated section 22 includes a cylindrical step 41 in the aft end of the elongated section 22. While the illustrated embodiment of the lethality enhancing device 13 contains a single cylindrical step 41 constituting approximately one-fifth of the axial length of the generally frustoconical elongated section 22, a greater portion or even the entire axial length of the generally frustoconical elongated section 22 can be formed by a plurality of axially spaced steps of differing diameters, with each step having a generally cylindrical configuration or a generally frustoconical configuration.

An annular liner wall 42 of cylindrical configuration is positioned exteriorly of and spaced from the inner wall member 20 with the central longitudinal axis of the annular liner wall 42 extending at least substantially along the central longitudinal axis 21 of the inner wall member 20. An annular body 43 of a low velocity explosive is positioned exteriorly of the inner wall member 20 and interiorly of the annular liner wall 42 with the central longitudinal axis of the annular body 43 of low velocity explosive also extending at least substantially along the central longitudinal axis 21 of the inner wall member 20. The annular body 43 of low velocity explosive has a generally frustoconical internal configuration so as to mate with the generally frustoconical external configuration of the inner wall member 22, and a generally cylindrical external configuration so as to mate with the cylindrical inner configuration of annular liner wall 42. Accordingly, the annular body 43 fills the annular space defined by the exterior surface of the generally frustoconical elongated section 22, the inner surface of annular liner wall 42, a portion of the forward surface of flange 24 and a portion of the aft surface of plate 31. Thus, in the illustrated embodiment, the annular body 43 of low velocity explosive has a cylindrical configuration radially adjacent the step 41 and a frustoconical configuration radially adjacent the remainder of the generally frustoconical wall section 22. As a result, the radial thickness of the low velocity explosive body 43 varies along the longitudinal length of the inner wall member 20.

The lethality enhancing device 13 contains five undeployed annular arrays 51–55 positioned at different locations along the longitudinal axis 21 coaxially with and exteriorly of the annular body 43 of low velocity explosive and the annular liner wall 42. Each annular array 51–55 has a circular configuration and contains a plurality of lethality enhancing objects 56, which are preferably spaced apart at equal intervals about the circumferential extent of the respective array. The lethality enhancing objects 56 are embedded in an annular layer comprising a matrix 57 of frangible material in order to maintain the lethality enhancing objects 56 in the desired relative positions while in the undeployed state in lethality enhancing device 13 but which is readily broken up so as to release the lethality enhancing objects 56 upon detonation of the low velocity explosive body 43. The matrix 57 is preferably a synthetic polymeric material containing hollow glass microspheres. The hollow glass microspheres substantially reduce the weight of the matrix 57 without a prohibitive sacrifice in the structural strength of the matrix 57. The hollow glass microspheres give shock mitigation, i.e., act as shock absorbers, and reduce the surface contact of the objects 56 with the polymeric material of the matrix 57, thereby facilitating separation of the objects 56 from the matrix 57. The presence of the resin matrix between the objects 56 and the low velocity explosive material 43 provides for a slower velocity of the objects 56 when deployed. The ratio of glass microspheres to resin in the matrix 57 can be varied to obtain the desired properties, such as structural integrity prior to the detonation of the low velocity explosive body 43. If desired, the hollow microspheres can contain a reactive material, such as an incendiary material or an exothermic material, e.g. thermite. Such incendiary material or exothermic material can still be included in the matrix 57 even when the microspheres are omitted. The matrix 57 itself can be formed from a reactant material, e.g. polytetrafluoroethylene. If desired, the matrix 57 can be in the form of an aluminum alloy cast about the objects 56. The aluminum alloy matrix is particularly advantageous where desired flexibility includes the option of the interceptor missile 11 being maintained intact until it impacts the target.

While each annular array 51–55 can be embedded in a single matrix 57 to position all of the annular arrays of lethality enhancing objects 56, it is presently preferred that each annular array 51–55 be in a respective discrete annular layer of frangible matrix material.

The number of lethality enhancing objects 56 in each array 51–55 can be the same or different. However, in the illustrated embodiment, array 51 contains twenty-eight lethality enhancing objects 56 spaced at equal centerline-to-centerline intervals of approximately 13° array 52 also contains twenty-eight lethality enhancing objects 56 spaced at equal centerline-to-centerline intervals of approximately 13°, array 53 contains twenty-four lethality enhancing objects 56 spaced at equal centerline-to-centerline intervals of approximately 15°, array 54 contains eighteen lethality enhancing objects 56 spaced at equal centerline-to-centerline intervals of approximately 20° and array 55 contains twelve lethality enhancing objects 56 spaced at equal centerline-to-centerline intervals of approximately 30°. While five annular arrays 51–55 have been illustrated, the number of annular arrays and the number of lethality enhancing objects 56 within each annular array can be varied in accordance with the size of the desired pattern of deployed lethality enhancing objects 56 and the spacing of the deployed objects 56 within the desired pattern. While it is presently preferred that the lethality enhancing objects 56 in each undeployed annular array be spaced apart at equal intervals about the circumferential extent of the respective array, the lethality enhancing objects 56 in a particular annular array can be spaced apart at differing intervals.

While it is possible for the positions of the lethality enhancing objects 56 in one of the annular arrays 51–55 to correspond to the positions of selected ones of the lethality enhancing objects 56 in another one of the annular arrays 51–55, e.g. the positions of the lethality enhancing objects 56 in the fifth annular array 55 corresponding to the positions of every other one of the lethality enhancing objects 56 in the third annular array 53, it is presently preferred that the angular intervals in each annular array be offset from the angular intervals in the adjacent annular arrays in order to provide a more uniform spacing of the objects when deployed. If desired, the ends of the objects 56 in one annular array can fit between the ends of the objects 56 in an adjacent annular array in order to reduce the total axial length required by the annular arrays 51–55. In general, the lethality enhancing objects 56 in a particular ring or array will be deployed in a circular pattern, with the lethality enhancing objects 56 of the array having the fastest deployment velocity forming a large diameter circular pattern, while the lethality enhancing objects 56 of the array having the slowest deployment velocity form a small diameter circular pattern, thereby forming a composite pattern of concentric circular arrays of deployed lethality enhancing objects 56.

The wall member 20 provides structure support for the lethality enhancing device 13 as well as a reactive mass against which the surrounding layer 43 of low velocity explosive reacts to drive the lethality enhancing objects 56 generally radially outwardly. The annular arrays 51–55 are positioned at different locations along the central longitudinal axis 21 of the annular body 43 of low velocity explosive such that the amount of energy provided to the plurality of objects 56 in one annular array is different from the amount of energy provided to the plurality of objects 56 in another annular array. For example, the radial deployment velocity of the objects 56 in the highest velocity array can be two to three times the radial deployment velocity of the objects 56 in the lowest velocity array. This variation in imparted energy can be achieved in any suitable manner.

In the illustrated embodiment, the amount of the low velocity explosive 43 in radial alignment with the first annular array 51 is greater than the amount of the low velocity explosive 43 in radial alignment with the second annular array 52, which in turn is greater than the amount of the low velocity explosive 43 in radial alignment with the third annular array 53, which in turn is greater than the amount of the low velocity explosive 43 in radial alignment with the fourth annular array 54, which in turn is greater than the amount of the low velocity explosive 43 in radial alignment with the fifth annular array 51. Thus, the amount of energy provided to each of the plurality of objects 56 in the first annular array 51 by the amount of the low velocity explosive 43 in radial alignment with the first annular array 51 is greater than the amount of energy provided to each of the plurality of objects 56 in the second annular array 52 by the amount of the low velocity explosive 43 in radial alignment with the second annular array 52, which in turn is greater than the amount of energy provided to each of the plurality of objects 56 in the third annular array 53 by the amount of the low velocity explosive 43 in radial alignment with the third annular array 53, which in turn is greater than the amount of energy provided to each of the plurality of objects 56 in the fourth annular array 53 by the amount of the low velocity explosive 43 in radial alignment with the fourth annular array 53, which in turn is greater than the amount of energy provided to each of the plurality of objects 56 in the fifth annular array 55 by the amount of the low velocity explosive 43 in radial alignment with the fifth annular array 55. However, the variation in energy provided the lethality enhancing objects 56 individually can also be achieved by varying the mass of the lethality enhancing objects 56, varying the composition of the low velocity explosive body 43 adjacent the various annular arrays 51–55, and/or by varying the thickness and/or rigidity of the inner wall 22 along its longitudinal axial length add thereby varying the implosion resistance of inner wall 22 from a location adjacent one annular array to a location adjacent another annular array. If desired, the energy provided to individual objects 56 in a particular ring can be varied from object to object in that ring by suitable variation in the composition and/or quantity of explosive material, by suitable variation in the mass of the objects in that ring, and/or by suitable variation in the underlying structure.

Figure 5:
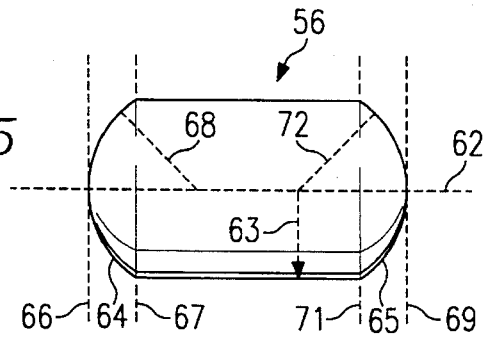
FIG. 5 is an illustration of a presently preferred configuration for the lethality enhancing objects.

Each of the lethality enhancing objects 56 should have an external configuration which minimizes aerodynamically induced deviations in the path of the object during the deployment of the object. Referring now to FIG. 5, the presently preferred configuration for a lethality enhancing object 56 is a cycloid, and more specifically, a shape of a right circular cylinder 61 having a longitudinal axis 62 and a radius 63, in combination with a first convex spherical segment 64 instead of a planar surface at the first end of the right circular cylinder 61 and a second convex spherical segment 65 instead of a planar surface at the second end of the right circular cylinder 61. The spherical segment 64 of a first sphere having its center on the longitudinal axis 62 is defined by two parallel planes 66, 67, which are perpendicular to the longitudinal axis 62, with the plane 66 being tangent to the first sphere and the distance between the two planes 66, 67 being less than or equal to the radius 68 of the first sphere with the radius 68 of the first sphere being greater than or equal to the radial dimension 63 of the right circular cylinder 61. Similarly, the spherical segment 65 of a second sphere having its center on the longitudinal axis 62 is defined by two parallel planes 69, 71, which are perpendicular to the longitudinal axis 62, with the plane 69 being tangent to the second sphere and the distance between the two planes 69, 71 being less than or equal to the radius 72 of the second sphere with the radius 68 of the second sphere being greater than or equal to the radial dimension 63 of the right circular cylinder 61. The lethality enhancing objects 56 are preferably positioned with their longitudinal axes at least generally parallel to the longitudinal axis 21 of the lethality enhancing device 13. In general each ratio of spherical radius to the cylindrical radius will be in the range of about 1:1 to about 10:1. However, it is presently preferred for the radius 68 of the first sphere to be equal to the radius 72 of the second sphere, and for the ratio of the spherical radius to the cylindrical radius to be in the range of about 1.1:1 to about 5:1 in order to simplify the formation of the lethality enhancing object 56 by sintering metal particles in a mold having the desired shape, such that no machining of the molded object is required. This presently preferred configuration for the lethality enhancing objects 56 permits the lethality enhancing objects 56 to be closely packed in the matrix 57 and to provide a greater total mass of the lethality enhancing objects in a given volume of objects 56 and matrix 57 than would be possible with a spherical configuration.

Each lethality enhancing object 56 is preferably fabricated from a dense metal. While any suitable dense metal can be employed, metals having a density of at least 15 g/cc are presently preferred, e.g. tantalum, tungsten, rhenium, uranium, etc. The higher densities permit a greater mass in a given volume or the same mass in a smaller volume, thereby enhancing the impact force of a lethality enhancing object 56 while decreasing the surface area exposed to aerodynamic forces. A presently preferred lethality enhancing object 56 is formed of pressed sintered particles of ductile tungsten. In general, each lethality enhancing object 56 will have a mass greater than about 50 grams, preferably greater than about 100 grams, and more preferably at least about 150 grams. In contrast, fragments from a blast fragmentation can be on the order of 1 to 10 grams.

While it is possible for the exterior surface of the matrix layer 57 containing the arrays of lethality enhancing objects 56 to constitute the outer cylindrical surface of the lethality enhancing device 13, an ablator layer 75 can circumferentially surround the matrix layer 57 to provide additional thermal protection during the flight of the missile 11. However, if employed, the ablator layer 75 does not have to constitute a significant component of the missile 11 from the standpoint of structural strength, and is readily penetrated by the lethality enhancing objects 56 upon deployment thereof without adversely affecting the paths of the lethality enhancing objects 56. The inner wall member 20 provides most of the structural strength of the lethality enhancing device 13 and opposes inwardly directed forces during detonation of the annular body 43. In an alternative embodiment, the layer 75 can be an external load-bearing wall formed of any suitable load bearing material, e.g. aluminum, titanium, graphite epoxy composite, etc., such that the inner wall 22 does not have to be a load bearing structure.

The plate 31 is provided with a plurality of holes 81 therethrough spaced apart from each other in a circular configuration so that the forward end of the annular body 43 of low velocity explosive is exposed to each of the holes 81. While any suitable number of holes 81 can be employed, the illustrated embodiment is provided with fourteen holes 81 positioned at equally spaced intervals in the circular configuration. Each hole 81 contains an initiator pellet 82 surrounded by an annular plastic support 83. An annular booster ring 84 is mounted on the front side of plate 31 so as to overlie each of the holes 81 and to cause the initiator pellets 82 to contact both the booster ring 84 and the annular body 43 of low velocity explosive. The booster ring 84 can be a plastic ring containing an explosive lead charge network. A suitable detonator 86, e.g. an exploding foil detonator device, is mounted to plate 31 by screws 87 so as to overlie a portion of the booster ring 84. Upon the application of an electrical firing signal to the detonator 86, the detonator 86 fires the explosive lead charge network in the booster ring 84, which ignites each of the initiator pellets 82 to thereby detonate the low velocity explosive material in annular body 43. The electrical firing signal can be provided in response to a sensor detecting the attainment of a desired distance to the target or in response to a signal representing the expiration of a predetermined time-of-flight. While the detonator 86 and the booster ring 84 are illustrated as being outside of the hollow interior of the inner wall 22, it is possible to position both the detonator and an annular booster ring within the hollow interior of the inner wall 22 so as to detonate the explosive material 43 through initiator pellets positioned in radial openings in the wall 22, thereby permitting a reduction in the length of the missile 11.

The annular body 43 of low velocity explosive should have a low velocity of detonation so that the radial deployment of the lethality enhancing objects 56 occurs at a relatively low velocity without deformation of the lethality enhancing objects 56 from the low velocity explosive forces. Any suitable low velocity explosive can be employed to form the annular body 43. While a detonation velocity less than about 6000 meters per second is generally considered to be a low detonation velocity value, the detonation velocity of the annular body 43 will generally be less than 5500 meters per second and will preferably be less than 5000 meters per second, and will more preferably be less than 4000 meters per second. The resulting radial deployment velocity of the objects 56 will generally be less than about 1000 feet per second, preferably less than about 600 feet per second, and more preferably less than about 500 feet per second. In contrast, granular, cast, or crystal TNT has a detonation velocity substantially in excess of 6000 meters per second, the speed of the interceptor missile 11 towards its target can exceed 5000 feet per second, and the speed of fragments resulting from a blast-fragmentation will normally be greater than 3000 feet per second. The special welding powder #6B, available from Trojan Corporation, Spanish Fork, Utah, has been employed in a loose powder form. However, it is presently preferred to incorporate the low velocity explosive material in a polymeric matrix to facilitate handling of the annular body 43 and to avoid any shifting of a powder explosive. Thus an explosive composition of pentaerythrol tetranitrate (PETN) in an elastomer, such as silicon rubber, is particularly useful. The amount of PETN in such composition will generally be in the range of about 10 to about 30 weight percent, preferably in the range of about 20 to about 25 weight percent, with the amount of the elastomer being in the range of about 90 to about 70 weight percent, preferably in the range of about 80 to about 75 weight percent. Foaming agents and high density metal additives can be added in order to achieve the desired combination of detonation pressure, energy, and explosive thickness. In general, the amount of low velocity explosive incorporated in the composition is a function of the thickness of the ring of low velocity explosive required for the lowest object deployment velocity. The minimum low velocity explosive thickness that will detonate is inversely proportional to the weight percentage of the low velocity explosive in the composite material. In general the annular body 43 will have a density of less than about 1.2 g/cc, and preferably less than about 1.1 g/cc. The low density of the annular body 43 reduces stress on the objects 56, and permits volume variations due to dimensional tolerances of the mold without causing significant changes in explosive energy.

The presently preferred low explosive composition is formed by mixing a liquid explosive, a powder explosive, a liquid polymerizable material containing a foaming agent, such that the liquid explosive acts to reduce the viscosity of the resulting mixture. A liquid polymerization catalyst is added to the mixture just prior to the injection of the mixture into a mold to produce a rigid foam. An exemplary composition comprises trimethylolethane trinitrate (TMETN), PETN, liquid (CO2-blown) polyurethane foam, and an isocyanate catalyst.

The use of low deployment velocities for the lethality enhancing objects 56 reduces the amount of low velocity explosive material needed to produce the desired pattern, as well as eliminates a need for a very sensitive firing system which would be required for use with high velocity fragments.

While the inner wall 20 has been illustrated with the generally frustoconical elongated section 22, other configurations can be employed. For example, the inner wall 20 can be in the form of a cylindrical member, a member having steps of increasing diameter and then steps of decreasing diameter, or a member having steps of decreasing diameter and then steps of increasing diameter. The inner wall 20 can be either a solid member or an annular member. When the inner wall 20 is an annular member, the wall thickness thereof can vary from one annular array of lethality enhancing objects 56 to another. While the inner wall 20 can be formed of any suitable material, even wood, it is presently preferred for the inner wall 20 to be formed of aluminum, titanium, an epoxy graphite composite, or a carbon-carbon composite.

Figure 6:
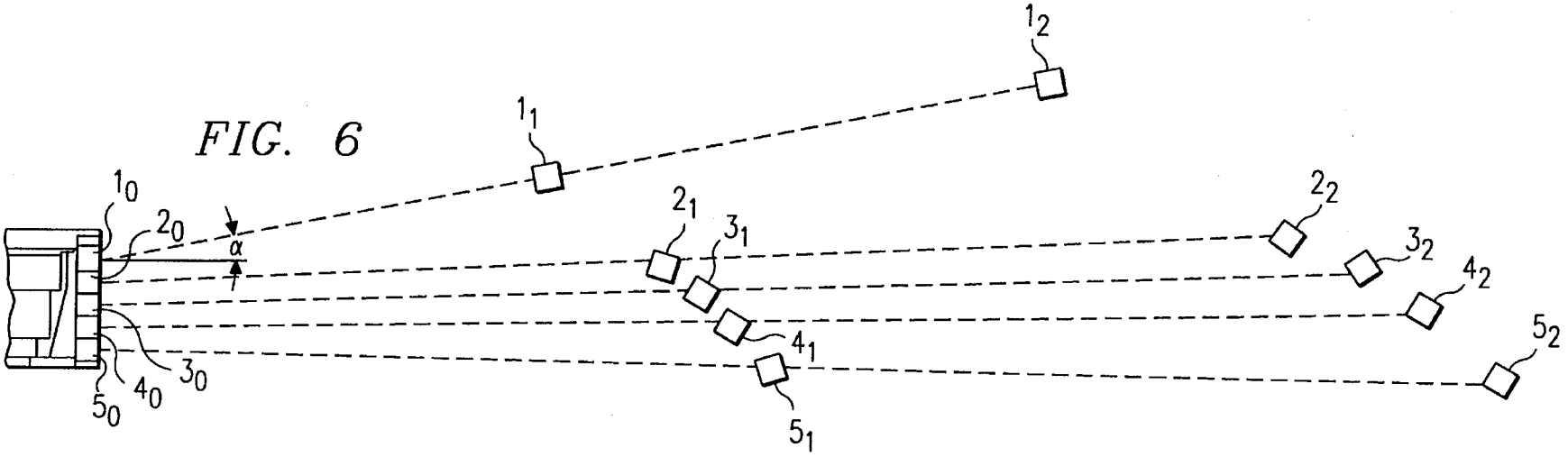
FIG. 6 is a representation of the dispersal pattern of one longitudinal column of objects as photographed at two points in time.
Figure 7:
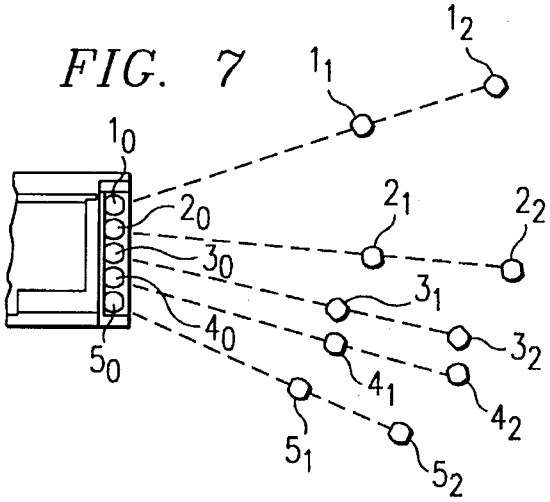
FIG. 7 is a representation of the dispersal pattern of another longitudinal column of objects as photographed at two points in time.

Each of two versions of a lethality enhancing device was mounted in a static test facility with the longitudinal axis of the respective device extending vertically. Each device had five annular rings or circular arrays of lethality enhancing objects. The inner wall member of each device was made of wood and had a generally frustoconical exterior surface, including one cylindrical step. The annular liner wall between the low velocity explosive body and the lethality enhancing objects was a thin sheet of aluminum. In each test, one row of axially aligned lethality enhancing objects (i.e., containing one object from each of the five rings) was isolated so that they would pass generally horizontally across a flash X-ray target screen with two time settings (4 and 8 milliseconds) for film exposure. The velocity of each lethality enhancing object in the isolated row was determined from the positions of the image of the respective lethality enhancing object on the film at the two time settings. The trajectory angle is the angle of deviation from the horizontal, as there was very little deviation in the azimuth plane. FIG. 6 is a representation of the radial deployment of the isolated row of lethality enhancing objects in Test 1, and FIG. 7 is a representation of the radial deployment of the isolated row of lethality enhancing objects in Test 2. In Test 1 the lethality enhancing objects were 200 g steel cubes and were placed in the desired position with the same number of lethality enhancing objects in each annular ring, while in Test 2 the lethality enhancing objects were encased in a syntactic foam, each lethality enhancing object in the isolated row had a cycloidal shape and was formed of 200 g of tungsten while the remaining lethality enhancing objects were 200 g steel cubes, the low velocity explosive quantity was reduced, and the number of lethality enhancing objects per ring was varied. In both tests, the lethality enhancing objects were bonded in position to the aluminum liner wall. In both tests, the annular body of low velocity explosive was constituted of loose special welding powder #6B, available from Trojan Corporation, Spanish Fork, Utah. The test results are summarized in the following table.

SUMMARY OF TEST DATA

| TEST | RING | OBJECTS/ RING | RING CHARGE (GRAMS) | VELOCITY (FPS) | TRAJECTORY ANGLE |
|---|---|---|---|---|---|
| 1 | 1 | 18 | 133.5 | 555 | 10.3° |
| | 2 | 18 | 212.9 | 671 | 2.6° |
| | 3 | 18 | 275.6 | 713 | 1.9° |
| | 4 | 18 | 353.0 | 744 | 1.3° |
| | 5 | 18 | 422.0 | 785 | −0.5° |
| 2 | 1 | 10 | 14.4 | 105 | −22.7° |

-continued

| SUMMARY OF TEST DATA | | | | | |
|---|---|---|---|---|---|
| TEST | RING | OBJECTS/ RING | RING CHARGE (GRAMS) | VELOCITY (FPS) | TRAJECTORY ANGLE |
| | 2 | 14 | 52.9 | 141 | −14.4° |
| | 3 | 16 | 89.9 | 142 | −11.8° |
| | 4 | 18 | 125.7 | 155 | −5.5° |
| | 5 | 18 | 107.1 | 156 | 17.8° |

The use of low velocity explosive material to launch the objects did not distort or weaken the deployed objects. These results indicate that a precision pattern of the lethality enhancing objects can be achieved by selecting the weight of low velocity explosive material and the number and mass of the lethality enhancing objects for each ring of lethality enhancing objects.

Analysis of lift and drag effects on the deployed pattern of lethality enhancing objects was performed for several different shapes of the lethality enhancing objects made from either steel or tungsten. The objects were sized to allow packaging of the desired number of objects in a single layer ring. The shapes tested included cylinder, cycloid, keystone, and spherical segment.

Each of the objects tested had at least substantially the same weight except for the first ring of the variable shape keystone. Differences in drag (axial force) cause a longitudinal displacement, but had negligible effect on radial and circumferential positions. The lift characteristics of each object was estimated using modified Newtonian theory which is accurate at the high Mach number of interest. The object is assumed to pitch or yaw at a constant rate which produces the maximum deviation at the specified end time. As the deviations vary with time squared, and the reference radial position varies linearly with time, the percentage deviations will be smaller at shorter times. The lift effects were analytically integrated to determine maximum, or worst case, deviations. The worse case radial and circumferential (lateral) deviations are summarized in the following table. The tests are ranked in order of radial deviation only. When lateral deviation is also considered, the configuration B cycloid is obviously the preferred shape.

| TEST | CONFIGURATION | MATERIAL | MAXIMUM RADIAL DEVIATION (%) | MAXIMUM CIRCUMFERENTIAL DEVIATION (%) |
|---|---|---|---|---|
| 1 | A | T | 2 | 21 |
| 2 | B | T | 7 | 7 |
| 3 | C | T | 8 | 8 |
| 4 | D | S | 8 | 68 |
| 5 | E | T | 13 | 13 |
| 6 | F | T | 14 | 13 |
| 7 | G | T | 15 | 9 |
| 8 | H | S | 25 | 30 |
| 9 | I | S | 33 | 33 |

T = tungsten alloy
S = steel alloy

Configuration A is a spherical segment defined between two planes which intersect each other at approximately 12° at a distance of approximately 3.4 inches from the center of a sphere having a radius of about 0.58 inch. The purpose of this modification of a spherical shape was to permit a denser packaging of the objects.

Configuration B is a cycloid having an overall length of approximately 1.4 inches, a cylindrical section with a diameter of approximately 0.8 inch and a length of approximately 1.1 inches, and two spherical segments each having a radius of approximately 0.55 inch.

Configuration C is a cylinder having a length to diameter of approximately 1.62.

Configuration D is a spherical segment defined between two planes which intersect each other at approximately 12° at a distance of approximately 3.4 inches from the center of a sphere having a radius of about 0.85 inch.

Configuration E is a cycloid having an overall length of approximately 1.8 inches, a cylindrical section with a diameter of approximately 0.7 inch and a length of approximately 1.5 inches, and two spherical segments each having a radius of approximately 0.5 inch.

Configuration F is a keystone in the form of a 12° sector of a circular ring having an inner diameter of approximately 3.5 inches, an outer diameter of approximately 4.4 inches, and a thickness of approximately 1 inch.

In configuration G, each of the five rings, having an inner diameter of approximately 3.8 inches and an outer diameter of approximately 4.4 inches, was divided into equal sectors, with the inclusion angle and the height (thickness) of the respective ring varying from ring to ring as follows: (1) approximately 30° and approximately 0.72 inch, (2) approximately 21.2° and approximately 0.76 inch, (3) approximately 16.4° and approximately 0.99 inch, (4) approximately 12.9° and approximately 1.26 inch, and (5) approximately 12.9° and approximately 1.26 inch. Each of the keystones in the first ring had a weight of approximately 267 grams, while each of the keystones in the remaining rings had a weight of approximately 200 grams.

Configuration H is a 12° sector of a circular ring having an inner diameter of approximately 3.5 inches, an outer diameter of approximately 4.4 inches, and a thickness of approximately 2 inches.

Configuration I is a cycloid having an overall length of approximately 2.9 inches, a cylindrical section with a diameter of approximately 0.8 inch and a length of approximately 2.6 inches, and two spherical segments each having a radius of approximately 0.56 inch.

Figure 8:
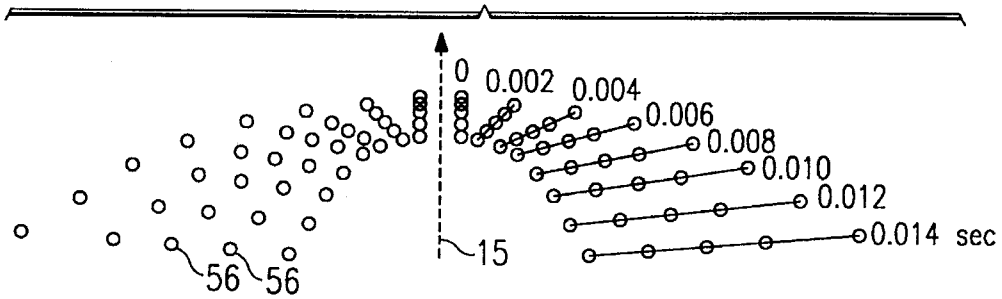
FIG. 8 is a simplified diagrammatic representation of the dispersal pattern of two longitudinal columns of objects at 0.002 second intervals.

The objects having the smallest aerodynamic-induced deviations are the sphere, the low L/D cycloid, and the cylinder, each being made from the higher density material. The primary factors in the determination of pattern deviations are the lift characteristics of the object and the initial pitch or yaw rates. Drag characteristics had a negligible effect other than displacing them aft, as illustrated in FIG. 8. FIG. 8 illustrates the deployment of two sets of lethality enhancing objects located on opposite sides of the longitudinal axis 15 of an interceptor missile 11 which is moving in the direction of the arrow. Each set includes one lethality enhancing object from each of five axially spaced rings of lethality enhancing objects. The positions of the right hand set of lethality enhancing objects are joined by solid lines for time intervals of 0.002, 0.004, 0.006, 0.008, 0.010, 0.012, and 0.014 second. It is apparent from FIG. 8 that the lethality objects 56 in the forwardmost ring are deploying at the greatest radial velocity, while the lethality objects 56 in the aftmost ring are deploying at the smallest radial velocity. Thus, for example, at 0.014 second, there are five concentric circular arrays of deployed lethality enhancing objects 56.

The cycloid shape provides a more efficient packaging than would a corresponding size spherical shape. The cycloid shape also resists damage due to the detonation of the low velocity explosive material 43, the breakup of the matrix 57, and the passage of the lethality enhancing object through the external layer 75. The cycloid shape also maintains its shape and mass upon initial impact with the target.

Reasonable variation and modifications are possible within the scope of the foregoing description, the drawings and the appended claims to the invention. For example, any suitable number of arrays of lethality enhancing objects can be employed. The mass of the lethality enhancing objects can vary within an array and from array to array. In order to adjust the direction of deployment of a lethality enhancing object, the lethality enhancing object can be positioned with its longitudinal axis at an angle to the longitudinal axis of the missile, the explosive body can be positioned at an angle to the longitudinal axis of the missile, and/or the location of the initial detonation points can be varied.

That which is claimed is:

1. A device for radially deploying a plurality of objects at a low velocity in order to achieve a predetermined pattern of the deployed objects, said device comprising:

an inner wall member having a central longitudinal axis, an annular body of low velocity explosive having a central longitudinal axis and a density of less than about 1.2 g/cc, said annular body of low velocity explosive having a detonation velocity of less than 6000 meters per second, said annular body of low velocity explosive being positioned exteriorly of said inner wall member with the central longitudinal axis of said annular body of low velocity explosive extending at least substantially along the central longitudinal axis of said inner wall member, a first plurality of objects positioned in a first annular array coaxially with and exteriorly of said annular body of low velocity explosive, a second plurality of objects positioned in a second annular array coaxially with and exteriorly of said annular body of low velocity explosive, said first and second annular arrays being positioned at different locations along the central longitudinal axis of said annular body of low velocity explosive, said annular body of low velocity explosive having a first amount of said low velocity explosive in radial alignment with said first annular array and a second amount of said low velocity explosive in radial alignment with said second annular array, said first amount of said low velocity explosive being different from said second amount of said low velocity explosive such that the energy provided by said first amount of said low velocity explosive is different from the energy provided by said second amount of said low velocity explosive.

2. A device in accordance with claim 1 wherein each of said first plurality of objects and each of said second plurality of objects have a shape which minimizes aerodynamically induced deviations in the path of the object during the deployment of the object.

3. A device in accordance with claim 1 wherein said inner wall member has a generally frustoconical external configuration, and wherein said annular body of low velocity explosive has a generally frustoconical internal configuration so as to mate with the generally frustoconical external configuration of said inner wall member.

4. A device in accordance with claim 3 wherein said annular body of low velocity explosive has a generally cylindrical external configuration such that said annular body of low velocity explosive has a radial thickness which varies along the longitudinal length of said inner wall member.

5. A device in accordance with claim 1 wherein each of said first annular array and said second annular array is a circular array.

6. A device in accordance with claim 1 wherein said annular body of low velocity explosive has a generally cylindrical external surface, a generally frustoconical internal surface, and a detonation velocity of less than 5500 meters per second.

7. A device in accordance with claim 1 wherein said first plurality of objects positioned in said first annular array is embedded in a layer of material so as to maintain the relative positions of said first plurality of objects while said first plurality of objects is in said device, and wherein said second plurality of objects positioned in said second annular array is embedded in a layer of material so as to maintain the relative positions of said second plurality of objects while said second plurality of objects is in said device.

8. A device in accordance with claim 7, wherein each said layer of material comprises a matrix formed of a synthetic polymeric material containing hollow glass microspheres.

9. A device in accordance with claim 1 wherein said first and second annular arrays are embedded in a single layer of material, further comprising a cylindrical housing having an external cylindrical surface, wherein the single layer of material forms a portion of said external cylindrical surface, and wherein said single layer of material is not capable of preventing the deployment of said first plurality of objects and said second plurality of objects.

10. A device in accordance with claim 1, further comprising a third plurality of objects positioned in a third annular array coaxially with and exteriorly of said annular body of low velocity explosive, said third annular array being positioned at a different location along the central longitudinal axis of said annular body of low velocity explosive from the locations of said first and second annular arrays, said annular body of low velocity explosive having a third amount of said low velocity explosive in radial alignment with said third annular array, such that said third amount of said low velocity explosive is different from said first amount of said low velocity explosive in radial alignment with said first annular array and from said second amount of said low velocity explosive in radial alignment with said second annular array.

11. A device in accordance with claim 1, further comprising a detonator positioned adjacent said annular body of low velocity explosive for detonating said annular body of low velocity explosive.

12. A device in accordance with claim 1, wherein the first plurality of objects in said first annular array is positioned at equal angular intervals in said first annular array, and wherein the second plurality of objects in said second annular array is positioned at equal angular intervals in said second annular array, with the angular intervals in said first annular array being offset from the angular intervals in said second annular array.

13. A device in accordance with claim 1, wherein the amount of said low velocity explosive in radial alignment with said first annular array is less than the amount of said low velocity explosive in radial alignment with said second annular array, and wherein the number of said second plurality of objects in said second annular array is greater than the number of said first plurality of objects in said first annular array.

14. A device in accordance with claim 1, wherein said annular body of low velocity explosive has a detonation velocity which is less than about 5500 meters per second, and wherein said first plurality of objects and said second plurality of objects are deployed at a velocity of less than about 1000 feet per second.

15. A device in accordance with claim 1, wherein each of said first plurality of objects and each of said second plurality of objects have a weight greater than about 50 grams.

16. A device in accordance with claim 1, wherein each of said first plurality of objects and each of said second plurality of objects are formed of a metal which has a density of at least 15 g/cc.

17. A device in accordance with claim 1, wherein said inner wall member provides most of the structural strength of said device and opposes inwardly directed forces during detonation of said low velocity explosive.

18. A device in accordance with claim 1, wherein each of said first and second pluralities of objects is pressed sintered particles of ductile tungsten.

19. A device for radially deploying a plurality of objects at a low velocity in order to achieve a predetermined pattern of the deployed objects, said device comprising:

an inner wall member having a central longitudinal axis, an annular body of low velocity explosive having a central longitudinal axis, said annular body of low velocity explosive having a detonation velocity of less than 6000 meters per second, said annular body of low velocity explosive being positioned exteriorly of said inner wall member with the central longitudinal axis of said annular body of low velocity explosive extending at least substantially along the central longitudinal axis of said inner wall member, a first plurality of objects positioned in a first annular array coaxially with and exteriorly of said annular body of low velocity explosive, a second plurality of objects positioned in a second annular array coaxially with and exteriorly of said annular body of low velocity explosive, said first and second annular arrays being positioned at different locations along the central longitudinal axis of said annular body of low velocity explosive, said annular body of low velocity explosive having a first amount of said low velocity explosive in radial alignment with said first annular array and a second amount of said low velocity explosive in radial alignment with said second annular array, said first amount of said low velocity explosive being different from said second amount of said low velocity explosive such that the energy provided by said first amount of said low velocity explosive is different from the energy provided by said second amount of said low velocity explosive, wherein each of said first plurality of objects and each of said second plurality of objects have a shape of a right circular cylinder having a longitudinal axis and having a convex spherical segment at each end of the right circular cylinder, each convex spherical segment being defined as a portion of a respective one of a first sphere and a second sphere, each of said first sphere and said second sphere having its center at least substantially on said longitudinal axis of said right circular cylinder, said portion being defined by a respective set of two parallel planes which are perpendicular to the longitudinal axis of the right circular cylinder, with one of the planes of each set being tangent to the respective sphere and the distance between the two planes in a set being less than or equal to the radius of the respective sphere with the radius of the respective sphere being greater than or equal to the radial dimension of the right circular cylinder.

20. A device in accordance with claim 19 wherein said annular body of low velocity explosive has a radial thickness which varies along the longitudinal length of said inner wall member.

21. A device in accordance with claim 19 wherein said annular body of low velocity explosive has a detonation velocity of less than 5500 meters per second.

22. A device in accordance with claim 19, wherein the amount of said low velocity explosive in radial alignment with said first annular array is less than the amount of said low velocity explosive in radial alignment with said second annular array, and wherein the number of said second plurality of objects in said second annular array is greater than the number of said first plurality of objects in said first annular array.

23. A device in accordance with claim 19, wherein said low velocity explosive has a detonation velocity which is less than about 5500 meters per second, and wherein said first plurality of objects and said second plurality of objects are deployed at a velocity of less than about 1000 feet per second.

24. A device for radially deploying a plurality of objects at a low velocity in order to achieve a predetermined pattern of the deployed objects, said device comprising:

an inner wall member having a central longitudinal axis, an annular body of low velocity explosive having a central longitudinal axis said annular body of low velocity explosive having a detonation velocity of less than 5500 meters per second, said annular body of low velocity explosive being positioned exteriorly of said inner wall member with the central longitudinal axis of said annular body of low velocity explosive extending at least substantially along the central longitudinal axis of said inner wall member, a first plurality of objects positioned in a first annular array coaxially with and exteriorly of said annular body of low velocity explosive, a second plurality of objects positioned in a second annular array coaxially with and exteriorly of said annular body of low velocity explosive, said first and second annular arrays being positioned at different locations along the central longitudinal axis of said annular body of low velocity explosive, said annular body of low velocity explosive having a first amount of said low velocity explosive in radial alignment with said first annular array and a second amount of said low velocity explosive in radial alignment with said second annular array, said first amount of said low velocity explosive being different from said second amount of said low velocity explosive such that the energy provided by said first amount of said low velocity explosive is different from the energy provided by said second amount of said low velocity explosive, wherein:

each of said first plurality of objects and each of said second plurality of objects have a shape of a right circular cylinder having a longitudinal axis and having a convex spherical segment at each end of the right circular cylinder, each spherical segment being defined as a portion of a respective one of a first sphere and a second sphere, each of said first sphere and said second sphere having its center at least substantially on said longitudinal axis of said right circular cylinder, said portion being defined by a respective set of two parallel planes which are perpendicular to the longitudinal axis of the right circular cylinder, with one of the planes of each set being tangent to the respective sphere and the distance between the two planes in a set being less than the radius of the respective sphere with the radius of the respective sphere being greater than the radial dimension of the right circular cylinder;

said inner wall member is an annulus having a generally frustoconical external configuration;

said annular body of low velocity explosive has a generally frustoconical internal configuration so as to mate with the generally frustoconical external configuration of said inner wall member;

said annular body of low velocity explosive has a generally cylindrical external configuration;

each of said first annular array and said second annular array is a circular array; and a detonator is positioned adjacent said annular body of low velocity explosive for detonating said annular body of low velocity explosive.

25. A device in accordance with claim 24 wherein:

said first plurality of objects positioned in said first annular array is embedded in a layer of material so as to maintain the relative positions of said first plurality of objects while said first plurality of objects is in said device;

said second plurality of objects positioned in said second annular array is embedded in said layer of material so as to maintain the relative positions of said second plurality of objects while said second plurality of objects is in said device; and said layer of material comprises a matrix formed of a synthetic polymeric material containing hollow glass microspheres.

26. A device in accordance with claim 25, further comprising a third plurality of objects positioned in a third annular array coaxially with and exteriorly of said annular body, said third annular array being positioned at a different location along the central longitudinal axis of said annular body from the locations of said first and second annular arrays, said annular body of low velocity explosive has a third amount of said low velocity explosive in radial alignment with said third annular array, such that said third amount of said low velocity explosive in radial alignment with said third annular array is different from said first amount of said low velocity explosive in radial alignment with said first annular array and from said second amount of said low velocity explosive in radial alignment with said second annular array.

27. A device in accordance with claim 25, wherein:

the first plurality of objects in said first annular array is positioned at equal angular intervals in said first annular array, and the second plurality of objects in said second annular array is positioned at equal angular intervals in said second annular array, with the angular intervals in said first annular array being offset from the angular intervals in said second annular array.

28. A device in accordance with claim 25, wherein:

the amount of said low velocity explosive in radial alignment with said first annular array is less than the amount of said low velocity explosive in radial alignment with said second annular array; and the number of said second plurality objects in said second annular array is greater than the number of said first plurality of objects in said first annular array.

29. A device in accordance with claim 24, wherein:

said first plurality of objects and said second plurality objects are deployed at a velocity of less than about 1000 feet per second; and each of said first plurality of objects and each of said second plurality of objects have a weight greater than about 50 grams and are formed of a metal which has a density of at least 15 g/cc.

30. A device in accordance with claim 29, wherein each of said first and second pluralities of objects is pressed sintered particles of ductile tungsten.

31. A device for radially deploying a plurality of objects, said device comprising:

a body of explosive having a central longitudinal axis, a first plurality of objects positioned in a first annular array coaxially with and exteriorly of said body of explosive, a second plurality of objects positioned in a second annular array coaxially with and exteriorly of said body of explosive, said first and second annular arrays being positioned at different locations along the central longitudinal axis of said body of explosive, wherein each of said first plurality of objects and each of said second plurality of objects have a shape of a right circular cylinder having a longitudinal axis and having a convex spherical segment at each end of the right circular cylinder, each convex spherical segment being defined as a portion of a respective one of a first sphere and a second sphere, each of said first sphere and said second sphere having its center at least substantially on said longitudinal axis of said right circular cylinder, said portion being defined by a respective set of two parallel planes which are perpendicular to the longitudinal axis of the right circular cylinder, with one of the planes of each set being tangent to the respective sphere and the distance between the two planes in a set being less than or equal to the radius of the respective sphere with the radius of the respective sphere being greater than or equal to the radial dimension of the right circular cylinder.

32. A device in accordance with claim 31 wherein said first plurality of objects positioned in said first annular array is embedded in a layer of material so as to maintain the relative positions of said first plurality of objects while said first plurality of objects is in said device, and wherein said second plurality of objects positioned in said second annular array is embedded in a layer of material so as to maintain the relative positions of said second plurality of objects while said second plurality of objects is in said device.

33. A device in accordance with claim 31, wherein each said layer of material comprises a matrix formed of a synthetic polymeric material containing hollow glass microspheres.

34. A device in accordance with claim 31, wherein the first plurality of objects in said first annular array is positioned at equal angular intervals in said first annular array, and wherein the second plurality of objects in said second annular array is positioned at equal angular intervals in said second annular array, with the angular intervals in said first annular array being offset from the angular intervals in said second annular array.

35. A device in accordance with claim 31, wherein each of said first plurality of objects and each of said second plurality of objects have a weight greater than about 50 grams.

36. A device in accordance with claim 31, wherein each of said first plurality of objects and each of said second plurality of objects are formed of a metal which has a density of at least 15 g/cc.

* * * * *

UNITED STATES PATENT AND TRADEMARK OFFICE

CERTIFICATE OF CORRECTION

PATENT NO. : 5,535,679

DATED : July 16, 1996

INVENTOR(S) : Gerald G. Craddock

It is certified that error appears in the above-indentified patent and that said Letters Patent is hereby corrected as shown below:

Column 16, line 22, delete "axis" and insert --axis,--.

Column 17, line 62, delete "claim 24," and insert --claim 28,--.

Column 17, lines63-64, delete "plurality" and insert --plurality of--.

Signed and Sealed this

Twenty-fourth Day of December, 1996

*Attest:*

Bruce Lehman

BRUCE LEHMAN

*Attesting Officer*

*Commissioner of Patents and Trademarks*